United States Patent [19]

Savigny

[11] Patent Number: 4,644,735

[45] Date of Patent: Feb. 24, 1987

[54] CONSTRUCTION FOR MOUNTING MESH BAGS ON BAG HANDLING PORTION OF AUTOMATIC WEIGHER/BAGGER MACHINE

[75] Inventor: James G. Savigny, Lockport, N.Y.

[73] Assignee: AG-PAK, Inc., Gasport, N.Y.

[21] Appl. No.: 740,401

[22] Filed: Jun. 3, 1985

[51] Int. Cl.[4] ..... B65B 43/46

[52] U.S. Cl. ..... 53/570; 53/384

[58] Field of Search ..... 53/384, 385, 386, 570, 53/573, 72, 390, 571

[56] References Cited

U.S. PATENT DOCUMENTS

| | | | |
|---|---|---|---|
| 3,731,454 | 5/1973 | Crabb | 53/55 |
| 3,789,573 | 2/1974 | Crabb | 53/386 |
| 4,172,349 | 10/1979 | Lipes | 53/385 |
| 4,291,517 | 9/1981 | Lipes | 53/573 |

FOREIGN PATENT DOCUMENTS

| | | | |
|---|---|---|---|
| 1308141 | 2/1973 | United Kingdom | 53/573 |

*Primary Examiner*—John Sipos
*Assistant Examiner*—Donald R. Studebaker
*Attorney, Agent, or Firm*—Joseph P. Gastel

[57] ABSTRACT

A wicket bar construction for mounting mesh bags on the bagger portion of an automatic weigher/bagger machine including a wicket bar, spaced prongs extending outwardly from the wicket bar and having first free ends and second ends attached to the wicket bar at junctions, the spaced prongs extending through spaced openings in the top rim of one side of the bags, and blades mounted at the junctions of the prongs and the wicket bar for severing the top strand adjacent the spaced openings when the bag is pulled away from the wicket bar.

11 Claims, 24 Drawing Figures

Fig. 1.
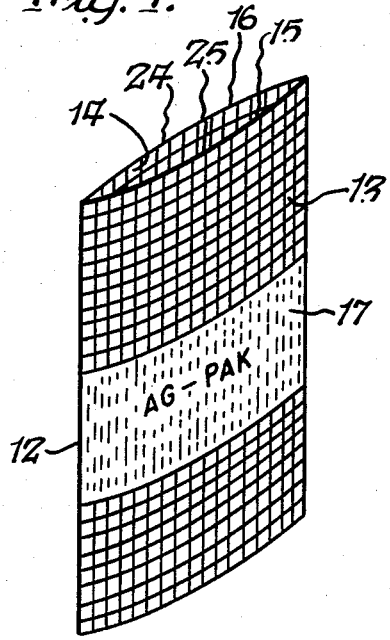
Fig. 2.
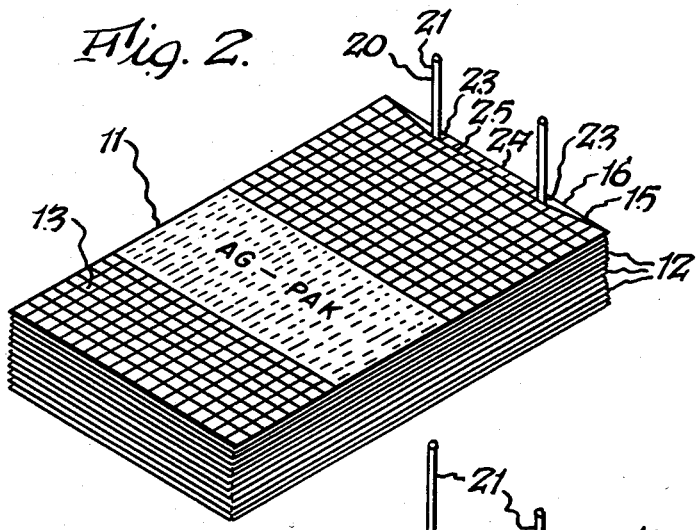
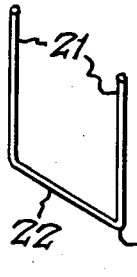
Fig. 3.
Fig. 4.
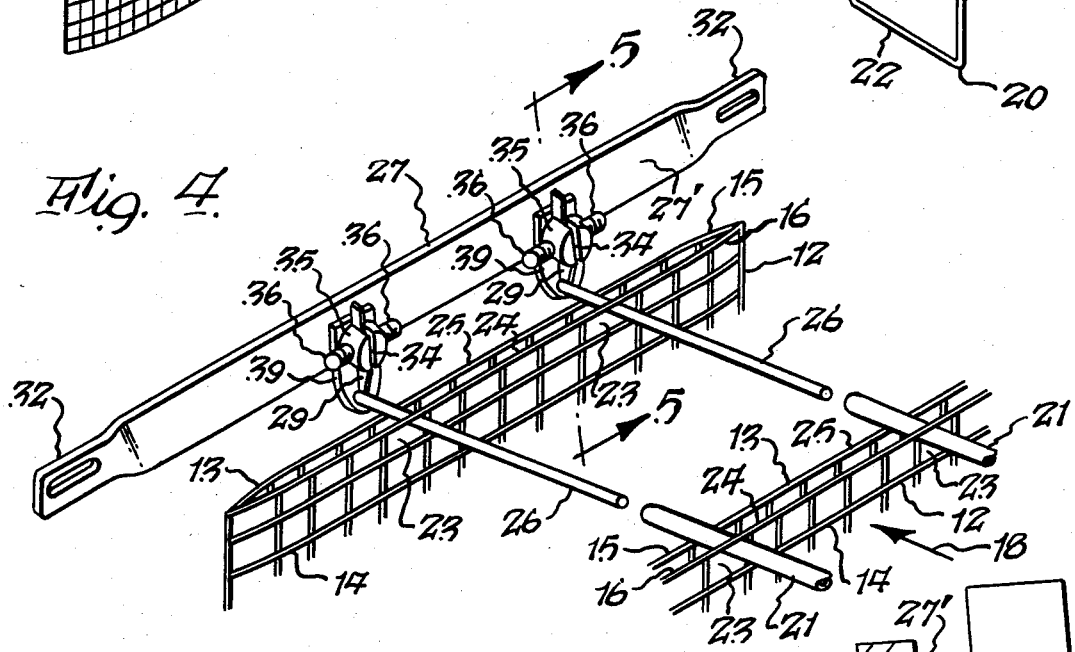
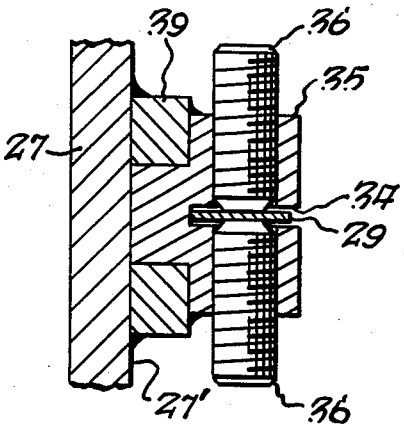
Fig. 6.
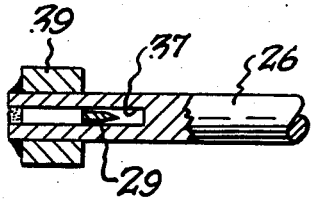
Fig. 7.
Fig. 5.
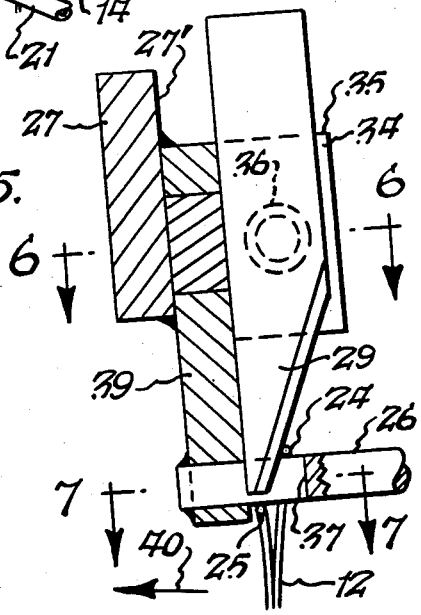

Fig. 13.
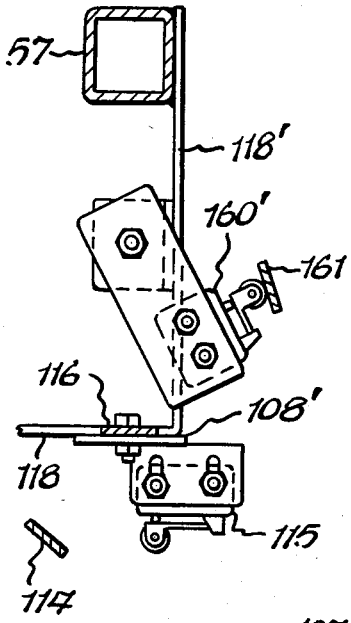
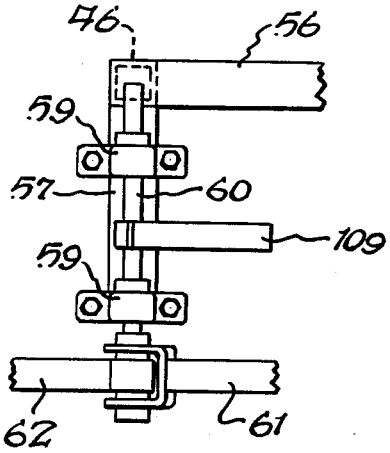
Fig. 10.
Fig. 11.
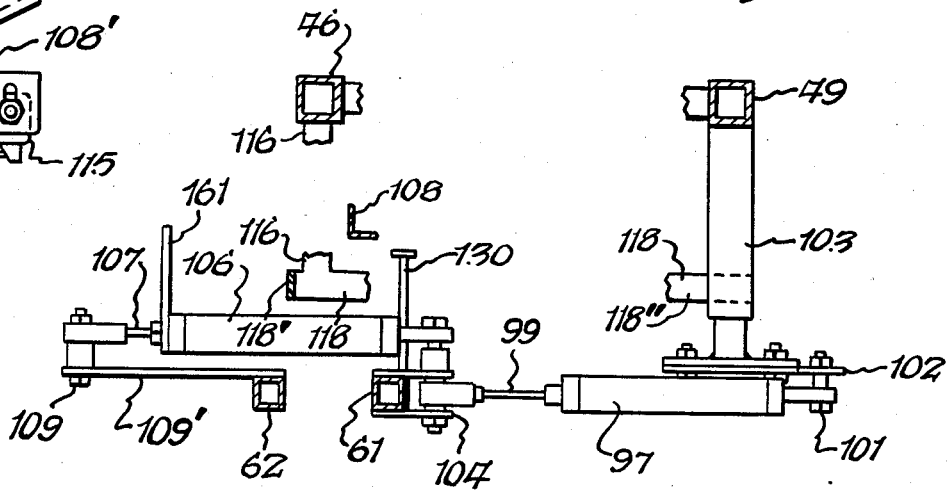
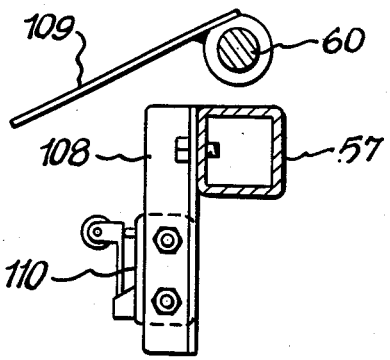
Fig. 12.
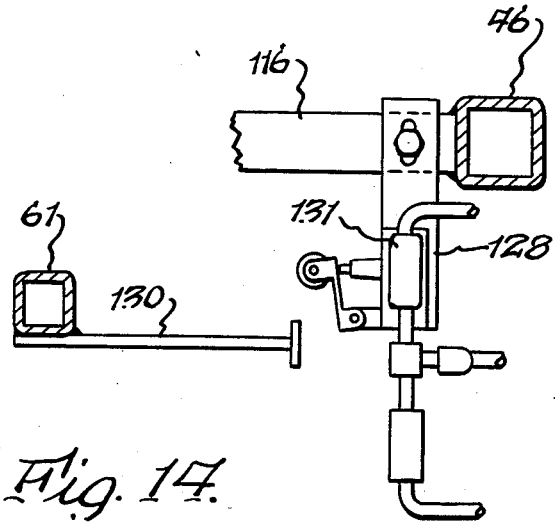
Fig. 14.

CONSTRUCTION FOR MOUNTING MESH BAGS ON BAG HANDLING PORTION OF AUTOMATIC WEIGHER/BAGGER MACHINE

BACKGROUND OF THE INVENTION

The present invention relates to an improved bag handling portion of an automatic weigher/bagger machine of the type in which produce is packed, the improvement residing in the manner in which mesh bags are handled by the machine.

By way of background, automatic weigher/bagger machines of the type shown in U.S. Pat. No. 3,731,454 are known. In addition, there are in use bag handling portions of weigher/bagger machines which mount sheet plastic bags on the prongs of wicket bars. The prongs extend through tabs which are extensions of one side of the bags, while the other side of the bags are unattached. A vacuum nozzle pulls the unattached side of the bag to produce an open mouth in the bag which receives spade members. When one of the spade members is pulled away from the other spade member, it rips the bag off of its mounting tab because of the fact that there is only a small amount of sheet plastic connecting the tab to the side of the bag. The present invention relates to a modification of the foregoing type of bagger machine which handles mesh bags of the type having spaced filaments which are joined to each other at their crossover junctions rather than sheet plastic bags.

SUMMARY OF THE INVENTION

It is the object of the present invention to provide a bagger machine mesh bag handling construction which both mounts mesh bags in an unique manner and which causes them to be detached from their mounting structure in an extremely efficient and positive manner. Other objects and attendant advantages of the present invention will readily be perceived hereafter.

The present invention relates to an improvement in an automatic bagging machine for handling a bag having a first side with a first upper rim portion and a second side with a second upper rim portion opposite to said first upper rim portion, said bagging machine having a rocker frame, a wicket bar mounted on said rocker frame and having a bag mounting side and an opposite side, first and second spaced prongs extending outwardly from said bag mounting side of said wicket bar, means for pulling said second side of said bag away from said first side to form an open mouth on said bag, a pair of spades having front faces and rear faces, means for moving said spades between a closed position wherein they are close to each other proximate said opposite side of said wicket bar and an open position wherein they are spread apart, means for moving said rocker frame to a higher position from a lower position when said spades are in said closed position proximate said wicket bar and when said bag has an open mouth to cause said open mouth to receive said spades in said closed position, and clamping means for clamping said first and second upper rim portions to said rear faces of said spades after said bag has been separated from said wicket bar, the improvement consisting of structure for releasing from said wicket bar mesh bags fabricated of spaced fiber strands with openings in said first upper rim portion therebetween and having first and second spaced openings which receive said first and second spaced prongs comprising first knife means, first means mounting said first knife means in contigous relationship to said first prong, second knife means, second mounting means mounting said second knife means in contiguous relationship to said second prong, said first and second knife means severing said uppermost fiber strand incidental to said spades being moved to said open position to thereby separate said bag from its mounted position on said first and second prongs.

The present invention also relates to a wicket bar construction for an automatic bagger comprising a wicket bar having opposite end portions and a central portion, first and second spaced substantially parallel elongated prongs each have first and second ends, first and second mounting means mounting said first ends at first and second junctions, respectively, on said wicket bar, first and second knife means, and first and second knife-mounting means mounting said first and second knives, respectively, proximate said first and second ends, respectively.

The various aspects of the present invention will be more fully understood when the following portions of the specification are read in conjunction with the accompanying drawings wherein:

BRIEF DESCRIPTION OF THE DRAWINGS

FIG. 1 is perspective view of the type of mesh bag which is handled by the improved bag handling portion of an automatic weigher/bagger machine;

FIG. 2 is a perspective view of a ream of mesh bags mounted on a U-shaped hollow tube prior to being mounted on the machine;

FIG. 3 is a perspective view of the U-shaped hollow tube on which the ream of mesh bags is mounted;

FIG. 4 is a fragmentary perspective exploded view showing the wicket bar of the present invention and also showing how each bag of the ream is mounted thereon and also showing how a ream of bags, such as shown in FIG. 2, is assembled onto the wicket bar by the U-shaped hollow tube;

FIG. 5 is a fragmentary enlarged cross sectional view taken substantially along line 5—5 of FIG. 4 and showing the cutting mechanism for severing a bag from the wicket bar;

FIG. 6 is a fragmentary cross sectional view taken substantially along line 6—6 of FIG. 5 and showing the structure for mounting a cutting blade on the wicket bar;

FIG. 7 is a fragmentary cross sectional view taken substantially along line 7—7 of FIG. 5 and showing the relationship between the cutting blade and one of the prongs of the wicket bar;

FIG. 10 is a fragmentary view taken substantially in the direction of arrows 10—10 of FIG. 8 and showing the pivot shaft for mounting the bag carrying arms and also showing the finger attached thereto which actuates a pneumatic switch which actuates a valve to cause the swinger cylinder to move the arms in a counterclockwise direction in FIG. 8 and which also actuates another valve to cause the bag clamping cylinders to open the clamps and which also actuates another valve to cause the spreader cylinder to pull the arms together;

FIG. 11 is a fragmentary cross sectional view taken substantially along line 11—11 of FIG. 8 and showing the swinger cylinder connected between the frame of the machine and one of the arms and also showing the spreader cylinder connected between the two arms;

FIG. 12 is a fragmentary cross sectional view taken substantially along line 12—12 of FIG. 9 and showing the finger described above relative to FIG. 10 in relation to its pneumatic switch;

FIG. 13 is a fragmentary cross sectional view taken subtantially along line 13—13 of FIG. 9 and showing the finger on the right arm which hits a pilot switch during movement of the right arm in a clockwise direction in FIG. 8 to actuate a valve which causes the vacuum cylinder to move the vacuum nozzle into engagement with the side of a mesh bag and also showing the finger on the spreader cylinder which contacts a fail-safe pilot switch when the arms are spread apart and holding a bag open to permit the machine to continue operation only when a bag is being held;

FIG. 14 is a fragmentary cross sectional view taken subtantially along line 14—14 of FIG. 9 and showing the vacuum hose cylinder actuating switch and the finger mounted on the right arm for actuating it when the right arm moves in a clockwise direction in FIG. 8 which is upward in FIG. 14;

DESCRIPTION OF THE PREFERRED EMBODIMENTS

Figures 8, 8A, 8B:
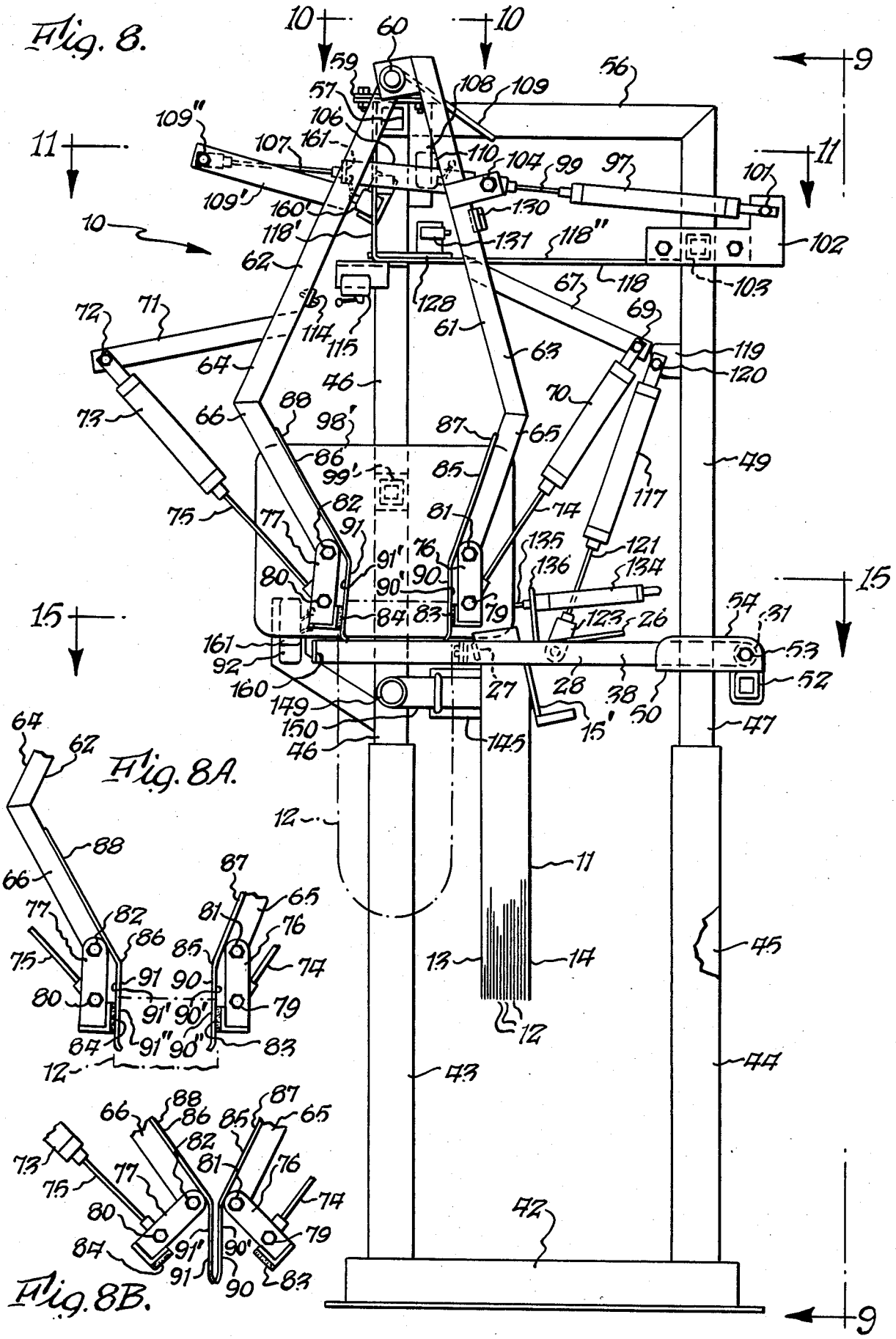
FIG. 8 is a side elevational view of the bag handling portion of an automatic weigher/bagger machine which incorporates the mesh bag mounting and severing structure of FIGS. 1–7.
FIG. 8A is a fragmentary side elevational view showing the spade-like members spread apart with the clamp member clamping the sides of the bag to them.
FIG. 8B is a fragmentary side elevational view showing the spade-like members together in the position where the open bag is moved upwardly to receive them.

Summarizing briefly in advance, the improved bag handling portion of the automatic weigher/bagger of the present invention mounts a ream of mesh bags on a rocker frame, pulls one side of the leading bag on the rocker frame to an open position while the other side remains mounted on the rocker frame, raises the rocker frame to receive a pair of spades in a closed condition, moves one of the spades away from the rocker frame to thus pull the mounted side of the closest bag off of the rocker frame by causing mesh portions of the bag which are mounted on the rocker frame to be severed, clamps the opposite sides of the bag to spade-like members which hold the opposite sides of the bag to a fully open position, and holds the bag so that it can be filled with product which is conveyed to it from a weigher (not shown). The other steps performed by the machine will be described hereafter. A basic machine which is related to the present machine is described in U.S. Pat. No. 3,731,454, which is incorporated herein by reference. The main structure of the present invention which differs from that disclosed in the foregoing patent is a mechanism for pulling a mesh bag mounted on a rocker frame to a partially open position and thereafter detaching the bag from the rocker frame by severing the parts of the mesh which hold the bag in mounted position.

The bag handling portion 10 (FIG. 8) of the machine mounts a ream 11 (FIG. 2) containing a plurality of mesh bags 12 having opposite side portions 13 and 14. The sides 13 have an upper edge 15 and the sides 14 have an upper edge 16. As is well understood, the mesh bags are fabricated from filaments which are suitably joined to each other at crossover junctions. The bags 12 are of the type in which produce such as potatoes or onions are sold. The bags may have labels, such as 17, suitably attached to sides 13 and 14 as shown.

The ream 11, prior to mounting on the machine, is mounted on a U-shaped member 20 (FIGS. 2 and 3), which is a hollow flexible plastic tube having parallel tubular leg portions 21 extending perpendicularly to base portion 22. The ream 11 is assembled on member 20 so that tubular leg portions 21 extend through two spaced openings 23 in the mesh immediately below top filament 24 at the uppermost edge 16 of each bag side 14 (FIGS. 2 and 4). Spaced tubular leg portions 21 also lie above the uppermost filament 25 of each bag side 13. Thus, each bag 12 has spaced legs 21 of U-shaped member 20 extending through openings 23 in side 14 and above uppermost filament 25 of side 13.

The ream 11 is mounted onto prongs 26 (FIGS. 4, 8 and 15) of wicket bar 27 of the machine by sliding tubular members 21 onto prongs 26 in the direction of arrow 18 (FIG. 4) and thereafter pushing the ream 11 onto spaced prongs 26 so that each bag 12 is ultimately mounted on spaced prongs 26 which extend through spaced openings 23 in the mesh, while the upper edge 25 of side 13 of each bag 12 lies below spaced prongs 26. When each bag 12 is mounted in the foregoing manner on spaced prongs 26, it can be pulled to a partially open condition by pulling side 13 away from side 14 while the latter remains mounted on prongs 26. The bag 12 is thereafter removed from wicket bar 27 by the structure of the present invention by pulling side 14 toward wicket bar 27, and in so doing causing blades 29 mounted at the junctions of prongs 26 and wicket bar 27 to sever the portions of top filament 24 immediately above spaced openings 23. A weight 15' is slidably mounted on prongs 26 which are tilted upwardly, and weight 15' biases ream 11 toward side 27' of wicket bar 27.

The wicket bar 27 is mounted on a rocker frame 28 (FIG. 15) consisting of spaced members 30 and 38 having first ends rigidly secured to tubular member 31 and opposite ends to which the ends 32 of wicket bar 27 are attached by wing nuts 33. The manner in which rocker frame 28 is mounted on machine 10 will be described in detail at an appropriate point hereafter.

The blades 29 (FIGS. 4–7) are mounted in slots 34 of bosses 35 by means of set screws 36. The lower portions of blades 29 are received in slots 37 of prongs 26 which are welded to plates 39 fixedly secured between wicket bar 27 and bosses 35. Therefore as each bag 12 is pulled in the direction of arrow 40 in FIG. 5, the upper filament 24 will be severed as it is pulled past the lower edges of blades 29.

The bag handling portion 10 of the machine includes a base 42 and hollow posts 43, 44 and 45 which extend upwardly therefrom. Posts 46, 47 and 49 are telescopically received in and extend upwardly from hollow posts 43, 44 and 45, respectively. Suitable structure (not shown) locks posts 46, 47 and 49 at a predetermined height. Brackets 50 and 51 (FIGS. 8, 9 and 15) are fixedly secured to posts 47 and 49, respectively, and are joined by tubular member 52 (FIG. 8). A pin 53 is affixed between legs 54 and 55 (FIG. 9) of brackets 50 and 51, respectively, and tubular member 31 of rocker frame 28 is pivotally mounted thereon for moving the rocker frame 28 between upper and lower positions, as will be described hereafter.

A horizontal frame member 56 (FIGS. 8 and 10) is connected across the tops of posts 46 and 49. A cantilevered arm 57 (FIGS. 8, 9 and 10) extends outwardly from the junction of post 46 and frame member 56. A plurality of spaced bearings 59 are secured to the top of arm 57 and pivotally support shaft 60. A first arm 61 (FIGS. 8 and 10) is fixedly secured to shaft 60 for pivotal movement therewith. A second arm 62 is pivotally mounted on shaft 60. Arms 61 and 62 have upper downwardly diverging portions 63 and 64, respectively, and lower downwardly converging portions 65 and 66, respectively, which are fixedly attached to their respective upper portions. A rigid bar 67 has one end fixedly attached to upper arm portion 63 and has a pin 69 at its opposite end pivotally mounting clamping cylinder 70. A rigid bar 71, which is similar to bar 67, has one end rigidly secured to upper arm portion 64 and has a pivotal connection 72 at its outer end which pivotally mounts clamping cylinder 73. Piston rods 74 and 75 extend outwardly from clamping cylinders 70 and 73, respectively, and their outer ends are pivotally secured to clamp members 76 and 77, respectively, at pivotal connections 79 and 80, respectively. Clamp members 76 and 77 have their upper ends pivotally connected to the lower ends of lower arm portions 65 and 66, respectively, at 81 and 82, respectively. Clamping members 76 and 77 have pads 83 and 84, respectively, at their lower ends which press against spade members 85 and 86, respectively, which have upper portions 87 and 88, respectively, fixedly secured to lower arm portions 65 and 66, respectively, and which have lower spade portions 90 and 91, respectively, which extend downwardly below lower arm portions 65 and 66, respectively, for the purpose of spreading the sides of a bag 12 apart, with clamp members 76 and 77 holding the bag against the rear faces 90' and 91' of lower spade portions 90 and 91, respectively, as shown in FIG. 8A, said lower spade portions 90 and 91 also having facing faces 90'' and 91'', respectively.

The bag handling machine operates as follows: For purposes of explanation, the start of a cycle of operation will be considered when arm 61 is in its full counterclockwise position with lower spade portion 90 closest to wicket bar 27 and with arm 62 spread away from it to cause lower spade portion 91 to be spaced from lower spade portion 90 as shown in FIGS. 8 and 8A. At this time a weigher machine (not shown) will discharge a load of produce into the open bag which is held by clamp members 76 and 77 on lower spaced portions 90 and 91. In this position, clamp cylinders 70 and 73 fully extend piston rods 74 and 75 as depicted by dotted lines in FIG. 22 because pilot valve 92 is in the position shown in FIG. 22 to cause supply air to be provided to valve 93 from main compressed airline 94. A plate 98' is mounted on arm 99' extending outwardly from post 46. Plate 98' acts as a deflector for produce being filled into an open bag 12 clamped onto spades 90 and 91.

Figure 22:
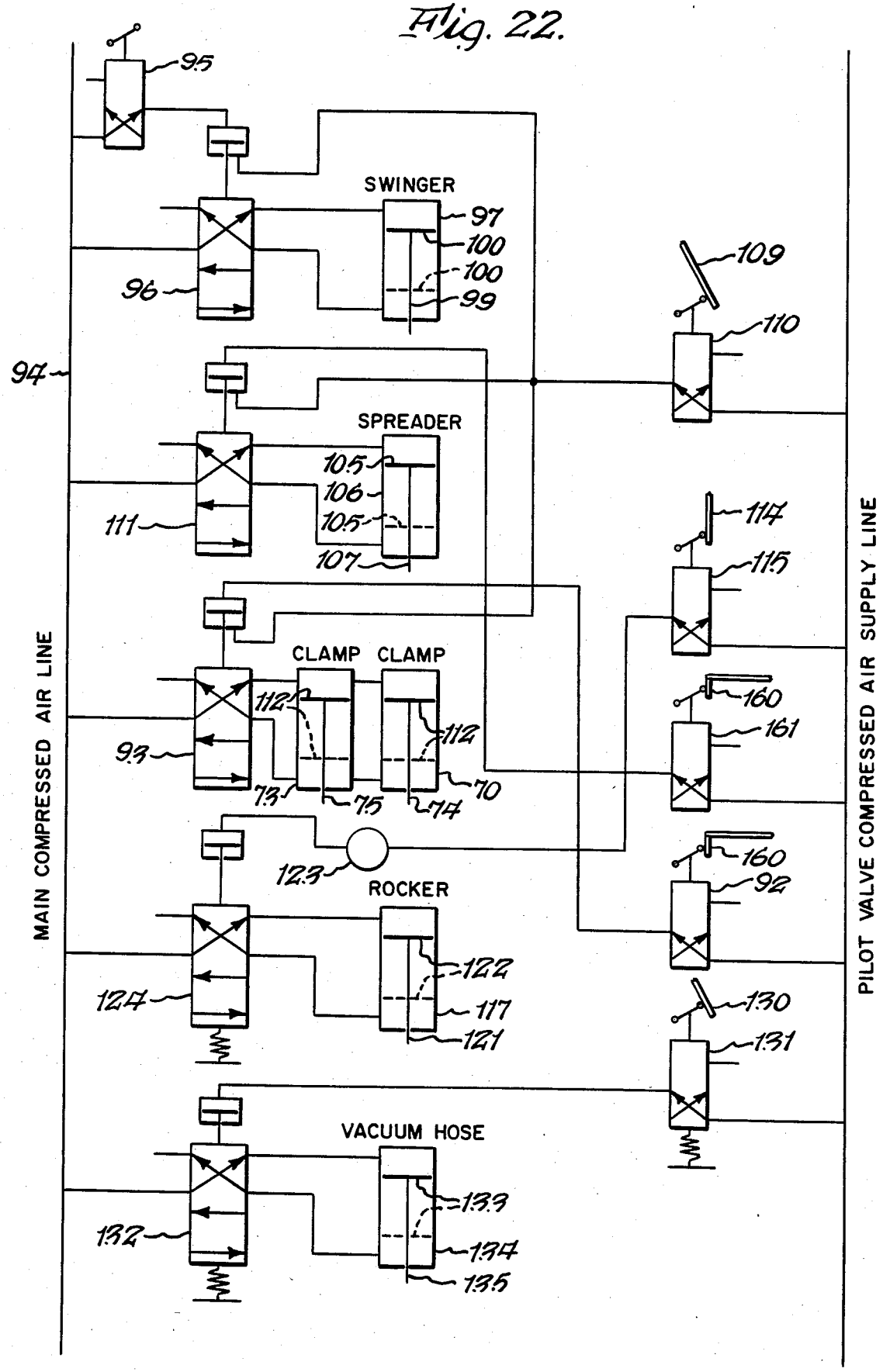
FIG. 22 is a schematic diagram of the pneumatic circuit of the bag handling portion of the machine of the preceding figures.

After a period of time, pilot valve 95 (shown only in FIG. 22) is actuated by a part of the weigher portion of the machine (not shown) to move to the position shown in FIG. 22 to supply air to swinger valve 96 which will cause it to move to the position of FIG. 22 to supply air to swinger cylinder 97 (FIGS. 8, 9 and 11) to extend piston rod 99 out of cylinder 97, that is, to move piston 100 from its solid line position to its dotted line position. Swinger cylinder 97 has its end pivotally mounted on pin 101 (FIGS. 8 and 11) mounted on bracket 102 which is affixed to the outer end of arm 103 mounted in cantilever fashion on post 49. The outer end of piston rod 99 is mounted by means of a trunnion connection at 104 to arm 61. Thus when piston rod 99 is extended, arms 61 and 62 will move clockwise (FIG. 8) in unison. This is the case because the piston 105 (FIG. 22) of spreader cylinder 106 is in its dotted line position to which causes piston rod 107 to be extended and thus cause arm 62 to be spread apart from arm 61 because the outer end of piston rod 107 (FIG. 11) is connected to arm 62 through pin 109'' and rigid link 109'.

As arms 61 and 62 move in unison in a clockwise direction because of the action of the swinger cylinder 97, they will convey a filled bag of produce to another station where the top of the bag is closed by suitable mechanism. Since this aspect forms no part of the present invention, the closing mechanism is not shown. During movement of arms 61 and 62 in a clockwise direction during the extension of swinger cylinder rod 99, finger 130 on right arm 61 (FIGS. 8, 11 and 14) will actuate pilot valve 131, which is mounted on bracket 128 secured to bar 116 extending between post 46 and strap 118, to supply air to vacuum hose cylinder valve 132 (FIG. 22) which causes the piston 133 of vacuum hose cylinder 134 (FIG. 15) to move from the solid-line to the dotted-line position (FIG. 22) and thus extend piston rod 135. Cylinder 134 is mounted on bracket 136 (FIGS. 8 and 15) which is secured to rocker frame side 30 by bolt 137. A pair of pins 139 and 140 (FIGS. 15, 19, 20 and 21) are adjustably mounted on piston rod 135. A bracket 141 (FIGS. 15 and 16) is welded to rocker frame side 30 and it carries a bearing 142 at its outer end. A pin 143 is pivotally mounted in bearing 142 and a lever 144 is fixedly secured to the top of pin 143. A horizontal leg 145' of bracket 145 (FIG. 16) is fixedly secured to the bottom of pin 143, and attached to vertical leg 148 of bracket 145 by means of U-clamps 146 is a vacuum hose nozzle assembly 147 having an open end 149 at the end of elbow 150. The open end 149 is approximately one inch in diameter. The opposite end of vacuum hose assembly 147 is connected to a flexible vacuum hose 151 attached to a suitable pump for providing sufficient vacuum so that the vacuum hose nozzle can pull bag side 13 to an open position. Also rigidly affixed to rocker frame side 30 is a plate 152 (FIG. 15) from which a pin 153 extends upwardly. A tension spring 154 has one end affixed to the upper end of pin 153 and its opposite end attached to upstanding portion 155 of lever 144.

Figure 15:
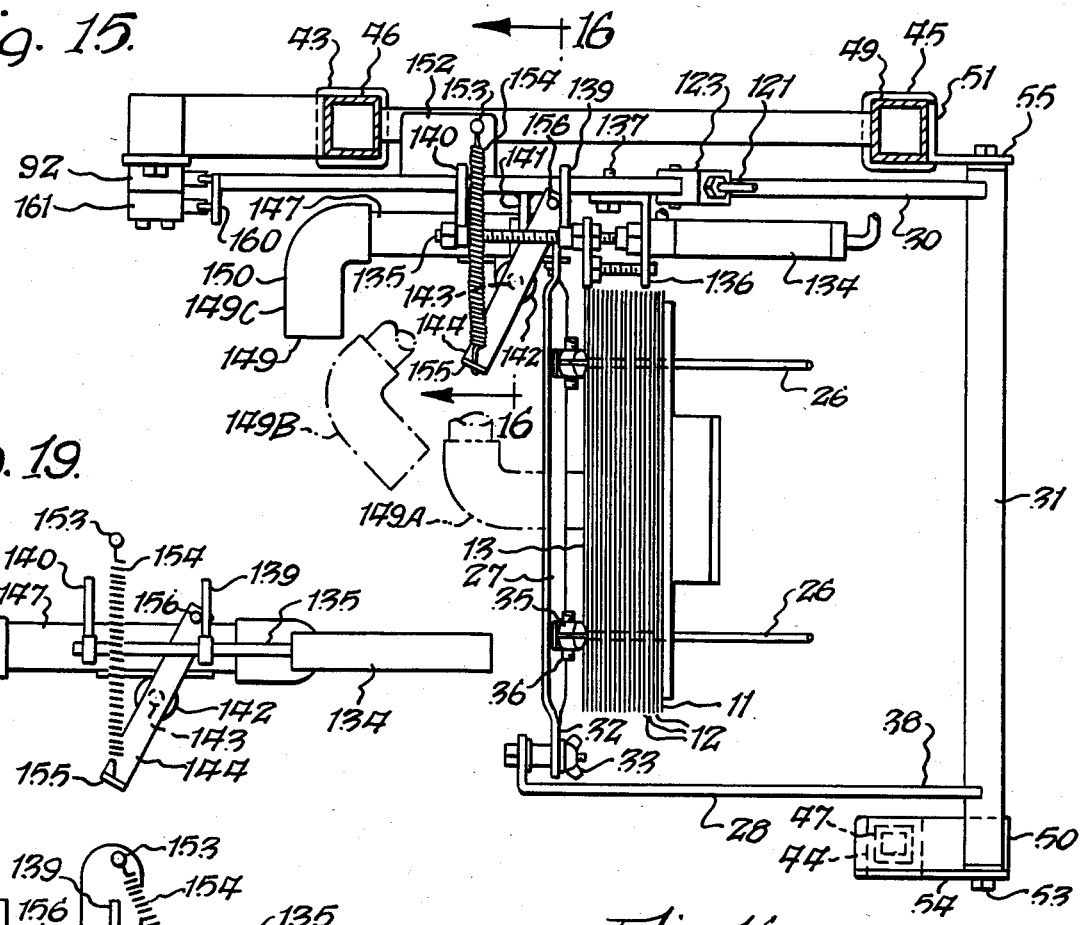
FIG. 15 is a cross sectional view taken substantially along line 15—15 of FIG. 8 and showing the rocker frame with the ream of bags mounted on the wicket bar thereof and also showing the structure for mounting the vacuum nozzle which is depicted in its three operating positions.
Figure 19:
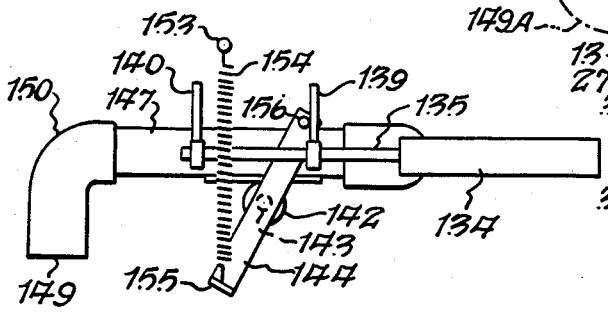
FIG. 19 is a view similar to FIG. 15 with numerous parts omitted showing the vaccum nozzle in its fully retracted position which it occupies after the arms reach a fully clockwise position in FIG. 8.
Figure 20:
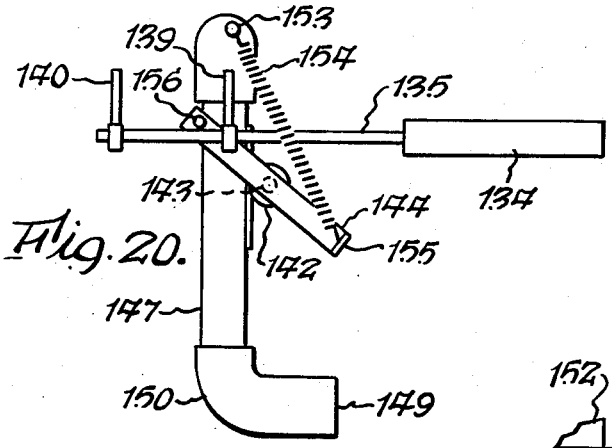
FIG. 20 is a view similar to FIG. 19 but showing the position of the vacuum nozzle after it is swung into engagement with the surface of the closest mesh bag during movement of the arms in their counterclockwise direction in FIG. 8.
Figure 16:
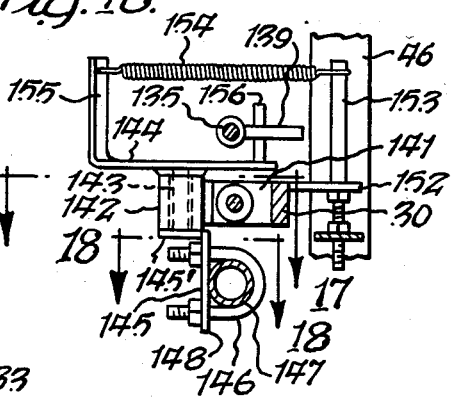
FIG. 16 is a fragmentary cross sectional view taken subtantially along line 16—16 of FIG. 15 and showing the vacuum nozzle mounting structure and linkage associated with the vacuum nozzle.
Figure 17:
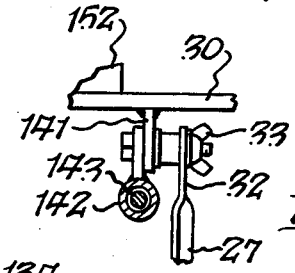
FIG. 17 is a fragmentary cross sectional view taken subtantially along line 17—17 of FIG. 16.

While vacuum hose piston rod 135 is being fully extended from the position of FIG. 19 to the position of FIG. 20, pin 139 on piston rod 135 will abut pin 156 at the end of lever 144 and move it to the left. This will cause spring 154 to move overcenter relative to the pin 143 on which lever 144 is mounted, and thus spring 154 moves vacuum hose assembly 147 to the position shown in FIG. 20 where the end of nozzle 149 is in abutting relationship to the side 13 of the outermost bag on ream 11 mounted on prongs 26 (FIG. 15). The position of nozzle 149 is shown at 149A in FIG. 15.

Figure 21:
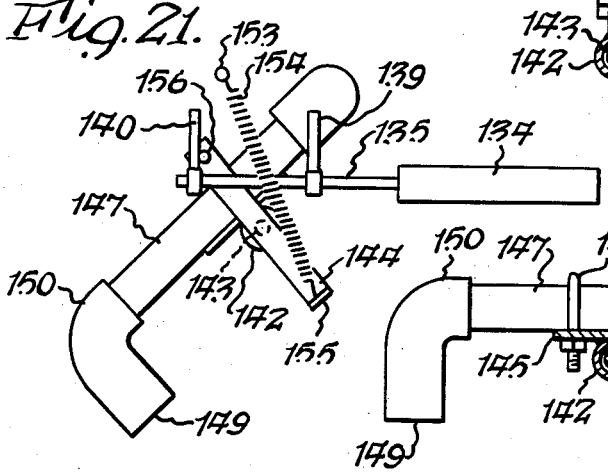
FIG. 21 is a view similar to FIG. 20 but showing the position of the vacuum nozzle after it has pulled one side of the mesh bag away from its adjacent side to permit the bag being raised by the rocker frame to receive the spades in their closed position when they are adjacent the rocker frame.
Figure 18:
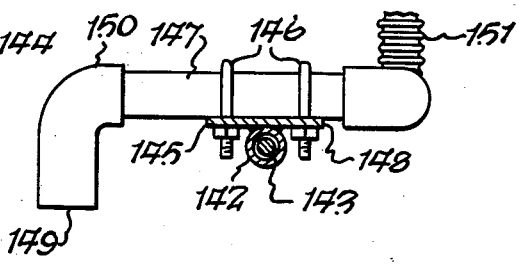
FIG. 18 is a fragmentary cross sectional view taken subtantially along line 18—18 of FIG. 16.

As finger 130 on right arm 61 loses contact with vacuum hose switch 131, the piston 133 (FIG. 22) will move from its dotted-line position to its solid-line position to thereby retract piston rod 135 to the position of FIG. 21 from its previous position of FIG. 20. In so doing, pin 140 at the end of piston rod 135 will engage pin 156 of lever 144 and move lever 144 to the position shown in FIG. 21 where spring 154 has not reached an overcenter position during clockwise movement of lever 144, but vacuum hose assembly 147 has been moved to the position shown in FIG. 21 and at 149B in FIG. 15. The application of vacuum to the side 13 of the outermost bag 12 of ream 11 will open the mouth of the bag by pulling side 13 away from side 14. At this time, when side 13 is pulled away from side 14 by nozzle 49, side 14 will still be held on prongs 26, as shown in FIG. 4 with upper filament 24 being close to blades 29.

Figure 9:
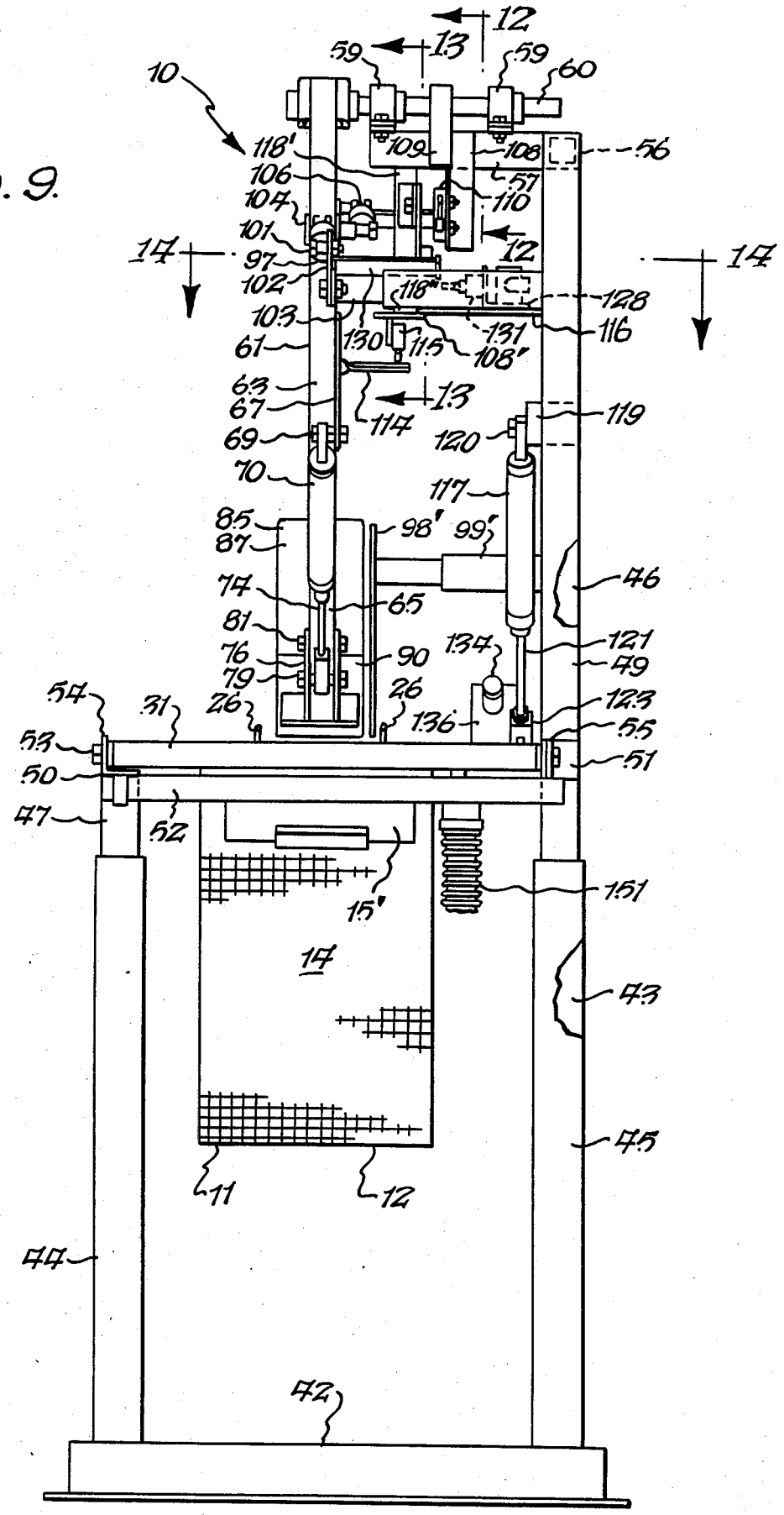
FIG. 9 is a side elevational view taken substantially in the direction of arrows 9—9 of FIG. 8.

At the end of the clockwise movement of arms 61 and 62, finger 109 (FIGS. 8, 10 and 12), which is fixedly secured to shaft 60 for pivotal movement therewith, will engage pneumatic pilot valve 110, which is mounted on bracket 108 which extends downwardly from arm 57 (FIGS. 9 and 12). Pilot valve 110 will move to the solid-line position of FIG. 22 to supply air to swinger cylinder valve 96 to actuate swinger cylinder 97 to cause piston rod 99 to be retracted by moving piston 100 to its solid-line position. This starts arms 61 and 62 moving in unison in a counterclockwise direction. At the same time, pilot valve 110 supplies air to spreader valve 111 which causes retraction of spreader piston rod 107 by causing piston 105 to move from its dotted-line position to its solid-line position and thus move arm 62 toward arm 61 during their joint counterclockwise movement so that the lower spade portions 90 and 91 come together as shown in FIG. 8B. Simultaneously, air is supplied from pilot valve 110 to valve 93 which supplies air to move the pistons 112 of clamp cylinders 70 and 73 from their extended dotted-line positions to their retracted solid-line positions to thereby open clamps 76 and 77 to the positions shown in FIG. 8B. After finger 109 leaves switch 110, air will no longer be supplied therethrough to valves 96, 111 and 93, and cylinders 97, 106, 70 and 73 will remain in their last-mentioned conditions until again actuated at further points in the cycle.

During the counterclockwise movement of arms 61 and 62 as described above, finger 114 on left arm 62 (FIGS. 8, 9 and 13) will engage pneumatic pilot valve 115 which is mounted on bracket 108' attached to the horizontal leg 118'' of strap 118 which has one end attached to arm 103 and the other end formed into vertical leg 118' which is secured to arm 57. The actuation of pilot valve 115 will supply air to rocker valve 124 to cause piston 122 of rocker cylinder 117 to move from the dotted-line position to the solid-line position and thus extend piston rod 121 to pivot rocker frame 28 in a clockwise direction about shaft 53 (FIG. 8). Cylinder 117 has one end pivotally mounted at 120 on bracket 119 attached to post 49, and trunnion 123 at the end of piston rod 121 is secured to rocker frame side 30. This will raise the rocker frame with the bag 12 at the end of the ream open so that the mouth of the bag will receive lower spade portions 90 and 91 which have already reached their counterclockwise limit of travel adjacent wicket bar 27. As the rocker frame 29 pivots upwardly, a finger 160 (FIGS. 8 and 15) at the end of rocker frame side 30 will engage pilot valve 161 (FIGS. 15 and 22) to supply air to spreader valve 111 which in turn supplies air to spreader cylinder 106 to extend the piston rod 107 of spreader cylinder 106 by moving piston 105 from its solid-line position to its dotted-line position. This will cause arm 62 (FIG. 8) to pivot in a clockwise direction away from arm 61 which remains stationary. Thus lower spade portion 91 will move bag side 13 further away from bag side 14 on prongs 26. Two important actions will now occur. The first action is to move bag side 13 sufficiently far so that the upper filament 24 of bag side 14 is forced against knives 29 to thus sever upper filament 24 in two spaced locations above spaces 23 and thus release bag 12 from prongs 26. Immediately after such release, side 14 of bag 12 is forced against the rear face 90' of lower spade portion 90, and thus the opposite sides 13 and 14 of bag 12 will be mounted on the rear faces 91' and 90', respectively, of lower spade portions 91 and 90, respectively. The second action is that as lower spade portion 91 moves clockwise, it abuts the end of nozzle 149 to thus pivot it in a clockwise direction about pin 143 (FIG. 21) to the point where spring 154 moves overcenter relative to pin 143 and thus returns the nozzle to position 149C shown in FIG. 15 where it is out of the path of the spades which will subsequently move in a clockwise direction to convey the bag held them to another position for tying, as described above. When the vacuum nozzle assembly 147 moves to the position 149C of FIG. 15 and to the position shown in FIG. 19, spring 154, after moving overcenter, will move lever 144 to the position shown in FIG. 19 wherein pin 156 at the end thereof abuts pin 139 on piston rod 135.

A fail-safe switch 160' is mounted on a vertical leg 118' of strap 118, and this switch is held closed by finger 161 (FIG. 11) mounted on the end of spreader cylinder 106 when arm 62 is in the position of FIG. 8 with a bag 12 mounted thereton. If for any reason a bag 12 is not mounted on spade 91 of arm 62 to restrict counterclockwise movement thereof, arm 62 will travel to a more counterclockwise position than shown in FIG. 8 and finger 161 will not contact switch 160', thereby causing the machine to stop.

There is a built-in delay 123 associated with rocker cylinder 117 so as to cause the rocker frame to move downwardly in a counterclockwise direction about shaft 53, but the downward movement does not occur until after the bag 12 is mounted on the spade members 90 and 91, as described above. As rocker frame 28 pivots in a counterclockwise direction, the finger 160 will hit switch 92 to cause the pistons 112 of clamp cylinders 70 and 73 to move from their solid-line positions to their dotted-line positions and thus clamp side 13 of the bag between lower spade portion 91 and clamp 84 an also clamp side 14 of the bag between lower spade portion 90 and clamp 83, thereby bringing the clamped bag 12 back to the initial point of the cycle, as referred to above. Suitable stops (not shown) are mounted on the frame of the machine to limit both the upward and downward movement of rocker arm 29.

While preferred embodiments of the present invention have been disclosed, it will be appreciated that the present invention is not limited thereto but may be otherwise embodied within the scope of the following claims.

What is claimed is:

1. In an automatic bagging machine for handling a bag having a first side with a first upper rim portion and a second side with a second upper rim portion opposite to said first upper rim portion, said machine having a rocker frame, bag mounting means including a wicket bar mounted on said rocker frame and having a bag mounting side and an opposite side, first and second spaced prongs extending outwardly from said bag mounting side of said wicket bar, vacuum nozzle means for engaging said second side and pulling said second side of said bag away from said first side to form an open mouth on said bag, a pair of spades having front faces and rear faces, means for moving said spades between a closed position wherein they are close to each other proximate said opposite side of said wicket bar and an open position wherein they are spread apart, means for moving said rocker frame to a higher position from a lower position when said spades are in said closed position proximate said wicket bar and when said bag has an open mouth to cause said open mouth to receive said spades in said closed position, and clamping means for clamping said first and second upper rim portions to said rear faces of said spades after said bag has been separated from said wicket bar, the improvement for releasing from said wicket bar mesh bags wherein said first and second sides are fabricated of spaced fiber strands with openings therebetween and with first and second spaced openings in said first upper rim portion between said spaced fiber strands and below the uppermost fiber strand which receive said first and second spaced prongs comprising first knife means, first means mounting said first knife means in contiguous relationship to said first prong, second knife means, second mounting means mounting said second knife means in contiguous relationship to said second prong, said first and second knife means severing said uppermost fiber strand incidental to said spades being moved to said open position to thereby completely separate said bag from its mounted position on said bag mounting means including said first and second prongs, said first knife means being mounted proximate the junction of said first prong and said bag mounting side of said wicket bar, said second knife means being mounted proximate the junction of said second prong and said bag mounting side of said wicket bar, first and second slots in said first and second prongs, respectively, proximate said first and second junctions, respectively, said first and second knife means extending into said first and second slots, respectively, and having portions extending above said first and second slots.

2. In an automatic bagging machine as set forth in claim 1 wherein said first and second knife means are mounted on said wicket bar.

3. In an automatic bagging machine as set forth in claim 1 wherein said prongs have ends remote from said junctions which are free and unobstructed to permit mounting of additional bags thereon while said machine is in operation.

4. In an automatic bagging machine for handling a bag having a first side with a first upper rim portion and a second side with a second upper rim portion opposite to said first upper rim portion, said machine having a rocker frame, bag mounting means including a wicket bar mounted on said rocker frame and having a bag mounting side and an opposite side, first and second spaced prongs extending outwardly from said bag mounting side of said wicket bar, vacuum nozzle means for engaging said second side and pulling said second side of said bag away from said first side to form an open mouth on said bag, a pair of spades having front faces and rear faces, means for moving said spades between a closed position wherein they are close to each other proximate said opposite side of said wicket bar and an open position wherein they are spread apart, means for moving said rocker frame to a higher position from a lower position when said spades are in said closed position proximate said wicket bar and when said bag has an open mouth to cause said open mouth to receive said spades in said closed position, and clamping means for clamping said first and second upper rim portions to said rear faces of said spades after said bag has been separated from said wicket bar, the improvement for releasing from said wicket bar mesh bags wherein said first and second sides are fabricated of spaced fiber strands with openings therebetween and with first and second spaced openings in said first upper rim portion between said spaced fiber strands and below the uppermost fiber strand which receive said first and second spaced prongs comprising first knife means, first means mounting said first knife means in contiguous relationship to said first prong, second knife means, second mounting means mounting said second knife means in contiguous relationship to said second prong, said first and second knife means severing said uppermost fiber strand incidental to said spades being moved to said open position to thereby completely separate said bag from its mounted position on said bag mounting means including said first and second prongs, said first knife means being mounted proximate the junction of said first prong and said bag mounting side of said wicket bar, said second knife means being mounted proximate the junction of said second prong and said bag mounting side of said wicket bar, said first and second mounting means comprising first and second bosses extending outwardly from said bag mounting side of said wicket bar, first and second slots in said first and second bosses, respectively, for receiving said first and second knife means, respectively, and first and second set screws for securing said first and second knife means, respectively, in said first and second slots, respectively.

5. In an automatic bagging machine as set forth in claim 4 wherein said prongs have ends remote from said junctions which are free and unobstructed to permit mounting of additional bags thereon while said machine is in operation.

6. In an automatic bagging machine as set forth in claim 4 including third and fourth slots in said first and second prongs, respectively, said first and second knive means extending into said third and fourth slots, respectively.

7. A wicket bar construction for an automatic bagger comprising a wicket bar having opposite end portions and a central portion, first and second spaced substantially parallel elongated prongs each having first and second ends, first and second mounting means mounting said first ends at first and second junctions, respectively, on said wicket bar, first and second knife means, first and second knive-mounting means mounting said first and second knife means, respectively, proximate said first ends of said first and second elongated prongs, respectively, and proximate said first and second junctions, respectively, said first and second knife-mounting means comprising bosses on said wicket bar, elongated slots in said bosses for receiving said first and second knife means, and means on said bosses for securing said knife means in said slots.

8. A wicket bar construction for an automatic bagger as set forth in claim 7 wherein said second ends of said first and second elongated prongs are unattached.

9. A wicket bar construction for an automatic bagger as set forth in claim 7 wherein said slots are substantially in line with said first and second elongated prongs.

10. A wicket bar construction for an automatic bagger as set forth in claim 7 including third and fourth slots in said first and second elongated prongs proximate said first and second junctions, respectively, said first and second knive means extending into said third and fourth slots, respectively.

11. A wicket bar construction for an automatic bagger as set forth in claim 10 wherein said means on said bosses for securing said knive means in said slots comprise set screws.

* * * * *